US005438347A

United States Patent [19]

Shishido et al.

[11] Patent Number: 5,438,347

[45] Date of Patent: Aug. 1, 1995

[54] MASTER MAKING DEVICE FOR A STENCIL PRINTER

[75] Inventors: Kamichika Shishido; Hidetoshi Aizawa, both of Shibata, Japan

[73] Assignee: Ricoh Company, Ltd., Tokyo, Japan

[21] Appl. No.: 63,609

[22] Filed: May 19, 1993

[30] Foreign Application Priority Data

May 19, 1992 [JP] Japan ..... 4-126318
May 19, 1992 [JP] Japan ..... 4-126320
Feb. 16, 1993 [JP] Japan ..... 5-026949

[51] Int. Cl.[6] ..... B41J 2/325

[52] U.S. Cl. ..... 347/218; 101/114; 101/116; 101/117; 101/118; 101/121; 101/126; 101/129; 346/134; 347/220

[58] Field of Search ..... 346/76 PH, 134; 101/114, 116, 117, 121, 126, 129, 118

[56] References Cited

U.S. PATENT DOCUMENTS 5,133,919 7/1992 Hasegawa et al. ..... 101/114

FOREIGN PATENT DOCUMENTS 0072591 4/1986 Japan ..... 346/76 PH

*Primary Examiner*—Huan H. Tran
*Attorney, Agent, or Firm*—Oblon, Spivak, McClelland, Maier, & Neustadt

[57] ABSTRACT

A master making device incorporated in a stencil printer. The operation for feeding the leading edge of a web or stencil toward a master clamper provided on a print drum is assigned to a platen roller. When the web is to be wrapped around the print drum, the operation for causing the web to form a slack and the operation for applying a tension to the web are implemented only by a tension member which selectively blocks or unblocks a web passageway.

6 Claims, 3 Drawing Sheets

MASTER MAKING DEVICE FOR A STENCIL PRINTER

BACKGROUND OF THE INVENTION

The present invention relates to a master making device for a stencil printer and, more particularly, to a master making device capable of transporting a web or stencil toward a master clamper openably provided on a print drum in a stencil printer.

Generally, a master making device incorporated in a stencil printer is made up of a thermal head for cutting a web or stencil to form a document image, a platen roller for pressing the web against the head, a first roller pair for transporting the web toward a printer body, a second roller pair for transporting the leading edge of the web being driven by the first roller pair toward a master clamper openably provided on a print drum included in the printer body, and a cutter for cutting off the web in a predetermined size. The print drum accommodates therein an ink supply tube for supplying ink, an ink roller to which the ink is applied, and a doctor roller for leveling the ink on the ink roller. Disposed in the printer body are a pair of register rollers for feeding a recording medium in the form of a sheet to the print drum at predetermined timing, a press roller for pressing the sheet against the stencil or master wrapped around the drum, and a separating member for separating the sheet or printing from the drum.

Japanese Utility Model Publication No. 33343/1989 discloses a rotary stencil printer having a master making device of the type causing a web to form a slack between two consecutive roller pairs (corresponding to the above-mentioned roller pairs). The web is wrapped around a print drum with the first roller pair being rotated. Japanese Patent Laid-Open Publication No. 188265/1985 proposes a tension adjusting method which causes a web to form a slack between a restricting member of a take-up device and a transport member (corresponding to the two roller pairs). This method adjusts the take-up speed of a print drum and the transport speed of the transport member such that the slack of the web does not exceed a predetermined size. Japanese Patent Laid-Open Publication No. 248282/1990 teaches a thermosensitive stencil transporting method which prevents electrostatic charges from depositing on transport rollers (corresponding to the two roller pairs) or on a stencil by reducing the contact area of the transport rollers and stencil or by use of a conductive brush or roller. Further, Japanese Utility Mode Laid-Open Publication No. 82566/1990 describes a stencil printer having a guide member for opening and closing a stock portion which receives a slack of a stencil and intervenes between a feed roller pair and a discharge roller pair. When the guide member opens the stock portion, a tension member applies a predetermined tension to the stencil.

In any one of the conventional master making schemes described above, assume that the web is fed at a speed higher than the rotation speed of the print drum while the former is wrapped around the latter. Then, the web wrapped around the drum will slacken and crease. This problem can be eliminated only if the linear velocity of the web and that of the drum are accurately synchronized. However, since the rotation of the drum is apt to become irregular, it is, in practice, difficult to synchronize the linear velocities of the web and drum accurately. In the light of this, it is a common practice to stop the rotation of the second roller pair at the time when the web is wrapped around the drum. In this condition, the second roller pair follow the rotation of the drum due to the pulling force of the web. As a result, an adequate degree of tension is applied to the web to prevent it from slackening on the drum.

However, causing the second roller pair to follow the rotation of the drum as stated above is undesirable since the rotation of the drum is irregular. Specifically, the irregular rotation of the drum changes the transport speed of the web relative the head, effecting the quality of the resulting master. Moreover, the irregular rotation is apt to exert an excessive load or tension on the web and break it. To eliminate these problems, the first roller pair is located between the second roller pair and the platen roller and rotated at a higher peripheral speed than the second roller pair. In this configuration, the web is caused to slacken between the two roller pairs, so that the excessive tension of the web due to the irregular rotation of the drum may be absorbed.

As stated above, it has been customary with a master making device to assign a plurality of different functions to the second roller pair, i.e., the function of feeding the leading edge of the web to the master clamper of the drum, the function of causing the web to slacken, and the function of applying a tension to the web when the web is to be wrapped around the drum. As a result, the arrangement for transporting the web is complicated and difficult to adjust. This increases the overall cost of the printer and obstructs efficient maintenance, i.e., degrades reliability against errors.

On the other hand, the platen roller has the function of transporting the web at a predetermined speed in addition to the function of pressing it against the surface of the head. It follows that the platen roller originally can transport the web alone and will implement an extremely simple master making device if the other transport members are not used. However, when the platen roller is used alone, it slackens and creases the web and effects the quality of the resulting master, as stated earlier.

By a series of extended researches and experiments, we found a method which is a solution to all of the problems discussed above.

However, although the transport system using only the platen roller to drive the web as described above successfully eliminates the various problems, it brings about another problem, as follows. The position where a transporting force acts on the web is remote from the position where the master clamper clamps leading edge of the web to the upstream side. Hence, on a transport path defined by a pair of guide plates, the transport of the leading edge of the web is extremely unstable. As a result, the leading edge of the web often jams the transport path between the guide plates and cannot be surely transported to the master clamper.

SUMMARY OF THE INVENTION

It is therefore an object of the present invention to provide a master making device for a stencil printer which realizes an extremely simple web transport arrangement by causing a platen roller to transport a web alone and allowing the leading edge of the web to be smoothly transported to a master clamper by guide plates.

In accordance with the present invention, a master making device for a stencil printer and capable of transporting a web toward a master clamper openably provided on a print drum comprises a receptacle for accommodating the web in the form of a roll, a thermal head for cutting the web paid out from the receptacle to thereby form a document image therein, a platen roller rotatable while pressing the web against the surface of the thermal head, and transporting the web toward the print drum while pulling it out of the receptacle, a cutter for cutting the web pulled out of the receptacle by the platen roller at a predetermined length, a guide plate defining a passageway for transporting the leading edge of the web transported by the platen roller toward the master clamper, and a tension member for unblocking the passageway when the master clamper is opened while facing a clamp position for clamping the leading edge of the web, or blocking the passageway in contact with the web when the master clamper is closed to clamp the leading edge of the web and the print drum is rotated for wrapping the web around the print drum. The tension member applies, when blocking the passageway, a tension to the web while causing the web to form a slack at a position downstream of the platen roller. The tension member is operated by the opening and closing movements of the master clamper to block or unblock the passageway.

Also, in accordance with the present invention, a master making device for a stencil printer and capable of transporting a web toward a master clamper openably provided on a print drum comprises a receptacle for accommodating the web in the form of a roll, a thermal head for cutting the web paid out from the receptacle to thereby form a document image therein, a platen roller rotatable while pressing the web against the surface of the thermal head, and transporting the web toward the print drum While pulling it out of the receptacle, a cutter for cutting the web pulled out of the receptacle by the platen roller at a predetermined length, and a guide plate defining a passageway for transporting the leading edge of the web transported by the platen roller toward the master clamper. The guide plate is curved in the same direction as a direction in which the web tends to curl.

BRIEF DESCRIPTION OF THE DRAWINGS

The above and other objects, features and advantages of the present invention will become more apparent from the following detailed description taken with the accompanying drawings in which.

In the figures, the same or similar constituents are designated by like reference numerals, and a detailed description will not be made to avoid redundancy.

DESCRIPTION OF THE PREFERRED EMBODIMENTS

Figure 3:
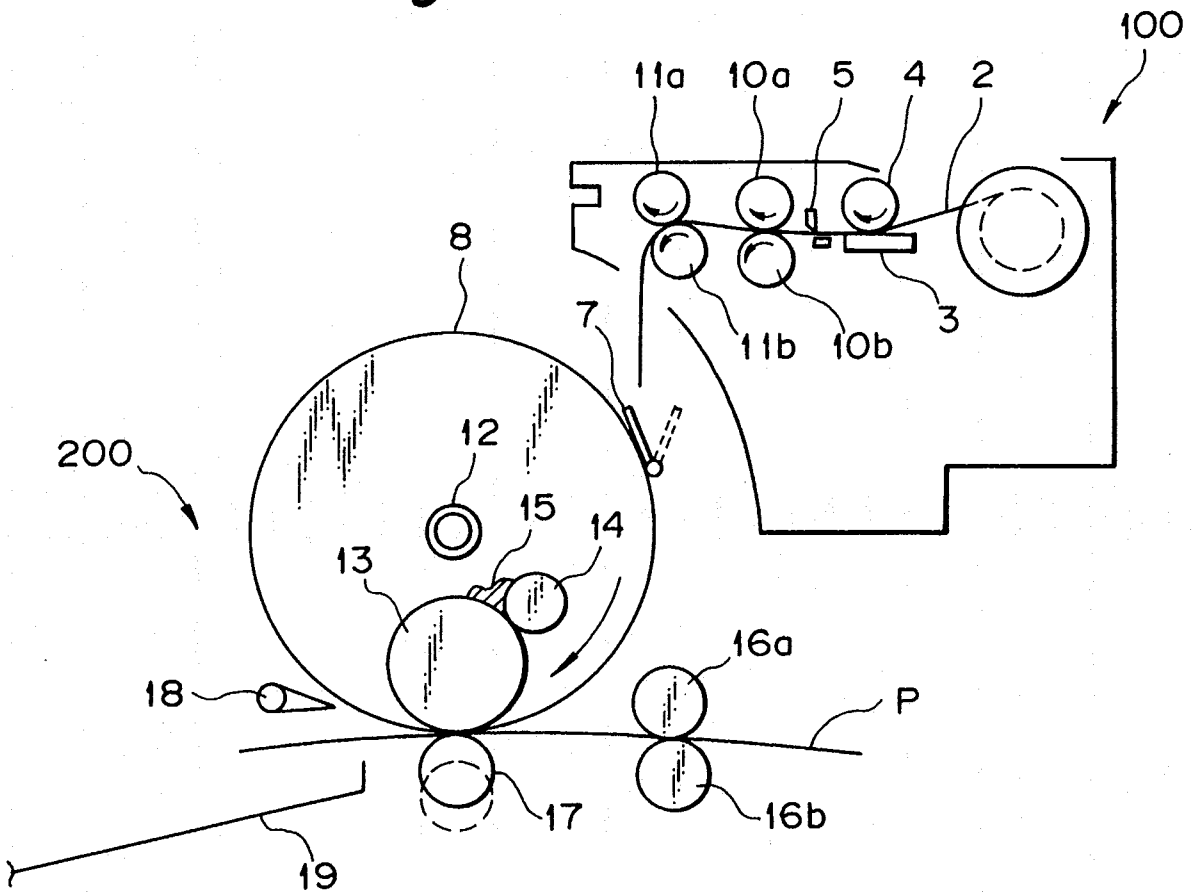
Fig. 3 PRIOR ART
FIG. 3 is a section of a conventional master making device for a stencil printer.

To better understand the present invention, a brief reference will be made to a prior art stencil printer and a master making device thereof, shown in FIG. 3. As shown, the stencil printer is generally made up of a body 200 and a master making device 100. A web or stencil 2 is implemented by a thermoplastic film and paid out from a roll accommodated in the master making device 100. A platen roller 4 presses the web 2 against the surface of a thermal head 3 while transporting it. A pair of feed rollers 10*a* and 10*b* follow the platen roller 4 and also transport the web 2. The thermal head 3 has a great number of heating elements arranged in an array on the surface thereof. A digital signal undergone various kinds of processing at an analog-to-digital conversion board and a master making control board, not shown, is sent to the head 3. In response, the heating elements of the head 3 are selectively energized. As a result, the web or stencil 2 pressed against the head 3 is cut by heat to form an image therein. Another pair of rollers or discharge rollers 11*a* and 11*b* drive the leading edge of the stencil or master 2 toward the body 200 of the machine. A print drum 8 is disposed in the body 200 while a master clamper 7 is openably provided on the drum 8.

As the master clamper 7 is opened and closed at predetermined timing, it clamps the leading edge of the master 2 driven thereto by the roller pair 11*a* and 11*b*. In this condition, the drum 8 is rotated in a direction indicated by an arrow in the figure to sequentially wrap the master 2 therearound. After the head 3 has formed an image in the stencil 2, the stencil 2 is further transported in a predetermined amount. Then, a cutter 5 cuts the stencil 2 at a predetermined length. The cut length of stencil or sheet is fully wrapped around the drum 8.

The drum 8 is made of a porous material and mounted on an ink supply tube 12 which is supported by flanges, not shown. A motor or similar drive means rotates the drum 8 in the direction shown in the figure. An ink roller 13 is accommodated in the drum 8 and supported by side walls, not shown, in such a manner as to be rotatable in the same direction as the drum 8 via, for example, a gearing. A doctor roller 14 faces the ink roller 13 while being spaced apart from the roller 13 by a small gap. The doctor roller 14 applies ink of a deposition 15 uniformly to the surface of the ink roller 13. A recording medium, e.g., a paper sheet P is fed from a sheet feed and separation device, not shown, to a register roller pair 16*a* and 16*b*. The register roller pair 16*a* and 16*b* drives the paper sheet P toward the surface of the drum 8 at predetermined timing. A press roller 17 is rotatable and movable toward and away from the master 2 wrapped around the drum 8. A separating member or separator 18 is also movable into contact with the drum 8 to separate the paper sheet P from the drum 8, as will be described.

As the paper sheet P is driven by the register roller 16 toward the drum 8, the press roller 17 is released from a retaining member, not shown, and moved away from a standby position indicated by a phantom line in the figure. On contacting the drum 8 via the paper sheet P, the press roller 17 is rotated by the drum 8 while pressing the paper sheet P against the master 2 wrapped around the drum 8. As a result, the ink supplied by the ink roller 13 to the inner periphery of the drum 8 is transferred to the paper sheet P via the cuts of the master 2. Then, the paper sheet or printing P is separated from the master 2 by the separator 18 which, like the press roller 17, will have been moved away from a standby position thereof then and lightly contacted the drum 8. Finally, the printing P is driven out of the printer to a tray 19.

Assume that the web 2 is fed at a speed higher than the rotation speed of the drum 8 while the former is wrapped around the latter 8. Then, the web 2 wrapped around the drum 8 will slacken and crease, as stated earlier. This problem can be eliminated only if the linear velocity of the web 2 and that of the drum 8 are accurately synchronized. However, since the rotation of the drum 8 is apt to become irregular, it is, in practice, difficult to synchronize the linear velocities of the web 2 and drum 8 accurately. In the light of this, in the master making device shown in FIG. 3, the rotation of the rollers 11*a* and 11*b* is stopped when the web 2 is being wrapped around the drum 8. In this condition, the rollers 11*a* and 11*b* follow the rotation of the drum 8 due to the pulling force of the web 2. As a result, an adequate degree of tension is applied to the web 2 to prevent it from slackening on the drum 8.

However, causing the rollers 11*a* and 11*b* to follow the rotation of the drum 8 as stated above is undesirable since the rotation of the drum 8 is irregular. Specifically, the irregular rotation of the drum 8 changes the transport speed of the web 2 relative to the head 3, effecting the quality of the resulting master. Moreover, the irregular rotation is apt to exert an excessive load or tension on the web 2 and break it. To eliminate these problems, in FIG. 3, the rollers 10*a* and 10*b* are located between the rollers 11*a* and 11*b* and the platen roller 4 and rotated at a higher peripheral speed than the rollers 11*a* and 11*b*. In this configuration, the web 2 is caused to slacken between the rollers 10*a* and 10*b* and the rollers 11*a* and 11*b*, so that the excessive tension of the web 2 due to the irregular rotation of the drum 8 may be absorbed.

As stated above, the rollers 11*a* and 11*b* have to serve a plurality of different functions, i.e., the function of driving the leading edge of the web 2 to the master clamper 7 of the drum 8, the function of causing the web 2 to slacken, and the function of applying a tension to the web 2 when the web 2 is being wrapped around the drum 8. As a result, the web transport arrangement is complicated and difficult to adjust. This increases the overall cost of the printer and obstructs efficient maintenance, i.e., degrades reliability against errors.

On the other hand, the platen roller 4 has the function of transporting the web 2 at a predetermined speed in addition to the function of pressing it against the surface of the head 3. It follows that the platen roller 4 originally can transport the web 2 alone and will implement an extremely simple master making device if the other transport members are not used. However, when the platen roller 4 is used alone, it slackens and creases the web 2 and effects the quality of the resulting master, as stated earlier. Moreover, the position where a transporting force acts on the web 2 is remote from the position where the master clamper 7 clamps the leading edge of the web 2 to the upstream side. Hence, on a transport path defined by a pair of guide plates, the transport of the leading edge of the web 2 is extremely unstable. As a result, the leading edge of the web 2 often jams the transport path between the guide plates and cannot be surely transported to the master clamper 7.

Preferred embodiments of the present invention will be described hereinafter which are free from the above-discussed problems.

Figure 1:
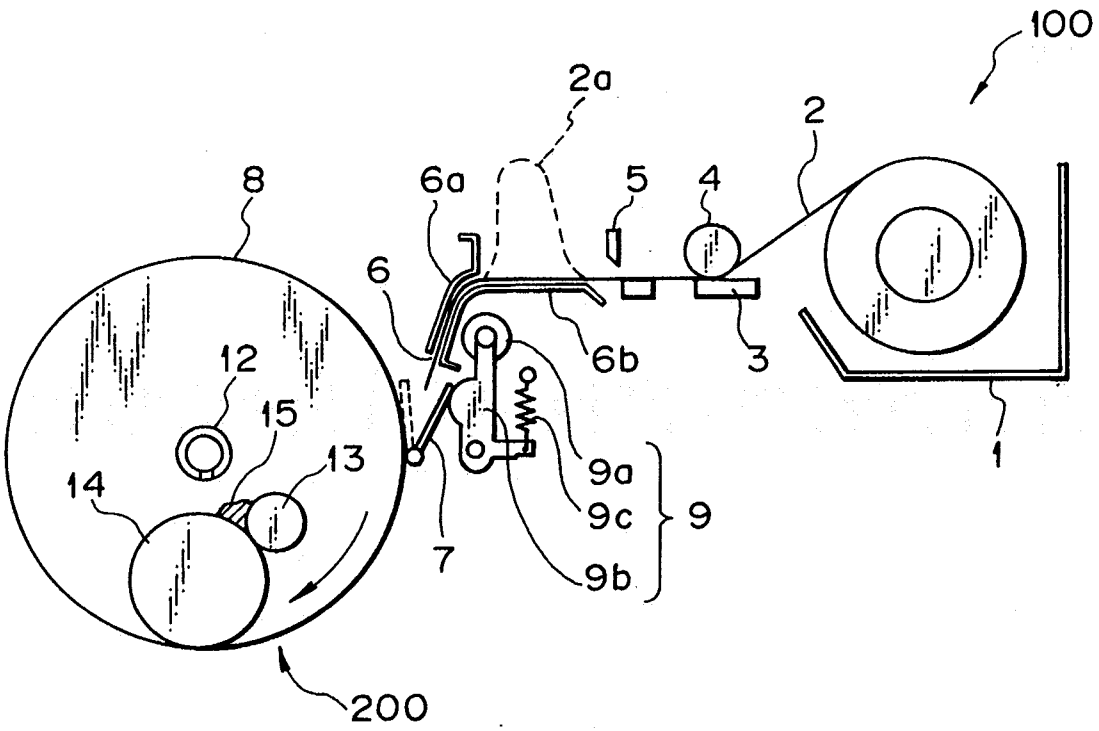
FIG. 1 is a section of a master making device for a stencil printer embodying the present invention.

Referring to FIG. 1, a stencil printer embodying the present invention is shown which has an extremely simple web transport arrangement. Briefly, paying attention to the fact that a platen roller 4 not only presses a web 2 against a thermal head 3 but also transports it, the embodiment causes the roller 4 to feed the leading edge of the web 2 toward a master clamper 7 of a print drum 8 alone. Also, the embodiment assigns the function of causing the web 2 to form a slack 2*a* and the function of applying a tension to the web 2 when it is being wrapped around the drum 8 only to a tension member 9. In the conventional printer, these functions are assigned to the roller pairs 10*a* and 10*b* and 11*a* and 11*b*. The tension member 9 blocks or unblocks a web transport passageway in association with the opening or closing movement of the master clamper 7.

Specifically, as shown in FIG. 1, a web 2 in the form of a roll is accommodated in a receptacle 1 included in a master making device 100. The web 2 is set in the device 100 by the following procedure.

To begin with, a release lever, not shown, is operated to release the platen roller 4 from the thermal head 3, thereby unblocking the master making path between the head 3 and the roller 4. In this condition, the leading edge of the web 2 is pulled out from the receptacle 1 and inserted into the unblocked path. Subsequently, the release lever is returned to its original position to press the platen roller 4 against the head 3 with the intermediary of the web 2. Then, a cut switch, not shown, is pressed. In response, the platen roller 4 is rotated clockwise as viewed in FIG. 1 to feed the leading edge of the web 2 toward a printer body 200 via a cutter 5 and guide plates 6*a* and 6*b* which define a passageway 6 therebetween.

As shown in FIG. 1, the web 2 is caused to project a slack 2*a* thereof outward of the passageway 6 at a particular position upstream of the passageway 6 and downstream of the cutter 5. Specifically, the upstream end of one of the guide plates (guide plate 6*a* in the embodiment) is open to accommodate the slack 2*a*. The tension member 9 is located downstream of the passageway 6, i.e., at the side where the leading edge of the web 2 is to be fed toward the master clamper 7. Specifically, the tension member 9 is made up of a tension roller 9*a*, a tension lever 9*b*, and a tension spring 9*c*. The tension lever 9*b* is movable in a pivotal motion in association with the opening and closing movements of the master clamper 7. The tension roller 9*a* is movable toward or away from the guide surface of one of the guide plates (guide plate 6*a* in the embodiment) via an opening, not shown, formed in the other guide plate 6*b* due to the pivotal motion of the tension lever 9*b*. The tension spring 9*c* constantly biases the tension lever 9*b* such that the tension roller 9*a* tends to move into contact with the guide surface of the guide plate 6*a*.

Assume that the master clamper 7 is closed for clamping the web 2, as indicated by a phantom line in FIG. 1. Then, the tension lever 9*b* is rotated counterclockwise under the action of the tension spring 9*c*. As a result, the tension roller 9*a* is brought into contact with the guide surface of the guide plate 6*a* to block the passageway 6. In this manner, when the web 2 is to be wrapped around the drum 8, the tension member 9 blocks the passageway 6 to exert a force tending to prevent the leading edge of the web 2 from advancing. Consequently, a tension is applied to the web 2, and the web 2 forms the slack 2*a* at a position downstream of the platen roller 4, precisely downstream of the cutter 5.

Therefore, when the web 2 is set in the master making device 100, the tension member 9 obstructs the advance of the leading edge of the web 2, as when the web 2 is being around the drum 8. In this condition, the platen roller 4 is further rotated to cause the web 2 to form the slack 2*a* at the position downstream of the cutter 5. As soon as the slack 2*a* of the web 2 reaches a predetermined size, the rotation of the platen roller 4 is stopped, and then the cutter 5 is operated to cut the web 2. It is to be noted that the above-mentioned "predetermined size" is determined by the amount of rotation of the platen roller 4. Subsequently, the cut length of the webbing 2 is removed from the passageway 6 with the slack or leader 2a thereof held by hand. The master making device 100 is now ready to operate with the web 2 fully set therein.

After the web 2 has been cut by the cutter 5 as stated above, the leading edge of the web 2 may be fed a predetermined distance beforehand to reduce the period of time necessary for the web 2 to be actually fed later. The "predetermined distance" should, of course, be shorter than the distance which causes the position of the web 2 where an image begins to be formed to exceed the head 3.

Assume that the web 2 has jammed the passageway 6 downstream of the cutter 5 due to misfeed or similar cause. Then, the previously mentioned cut switch is pressed to cause the web 2 to form the slack 2a, as at the time of setting the webbing 2. Subsequently, the leader of the web 2 is cut off by the cutter 5 and removed by hand. This makes it needless to set the web 2 in the device 100 all over again.

Now, assume that after the web 2 has been fully set in the device 100 by the above procedure, a master used to produce printings is separated from the drum 8 and and a stencil feed command is generated, or a feed start switch, not shown, is pressed. Then, the platen roller 4 is rotated to transport the stencil or web 2 toward the drum 8. The head 3 cuts the webbing 2 to make a master. At this instant, the master clamp 7 is opened while facing the leading edge of the web 2, as stated previously and as indicated by a solid line in FIG. 1. In this condition, the open end of the master clamper 7 abuts against the side of the tension lever 9b and causes it to rotate clockwise against the action of the tension spring 9c. As a result, the tension roller 9a is moved away from the guide surface of the guide plate 6a to unblock the passageway 6. Then, the leading edge of the web 2 is transported by the platen roller 4 into the open end of the master clamper 7 along the guide plates 6a and 6b which are so curved as to be substantially tangential to the drum 8. As the leading edge of the web 2 abuts against a shaft on which the master clamper 7 is mounted, the clamper 7 is closed to clamp the web 2 on the drum 8.

When the master clamper 7 is moved away from the tension lever 9b in the closing direction, the tension lever 9b is restored to its original position by the tension spring 9c. Consequently, the tension roller 9a urges the web 2 against the guide surface of the guide plate 6a. This is successful in allowing the web 2 to be clamped in an accurate position at all times.

After the master clamper 7 has clamped the leading edge of the web 2 and the tension member 9 has blocked the passageway 6, the drum 8 is rotated in a direction indicated by an arrow in FIG. 1. Then, the tension member 9 exerts a force tending to obstruct the advance of the web 2, thereby applying a tension to the web 2. At the same time, the web 2 forms the slack 2a at the position downstream of the cutter 5. As a result, the web 2 is wrapped around the drum 8 without being creased or subjected to an excessive tension.

In the above condition, the tension acting on the web 2 can be readily changed by adjusting the force of the tension spring 9c. When the web 2 is being wrapped around the drum 8, the drum 8 is controlled to rotate at the same peripheral speed as the platen roller 4 to maintain the size of the slack 2a constant. After the head 3 has fully formed an image in the web 2, the web 2 is further transported in a predetermined amount and then cut off by the cutter 5. The resulting sheet or master is fully wrapped around the drum 8.

Figure 2:
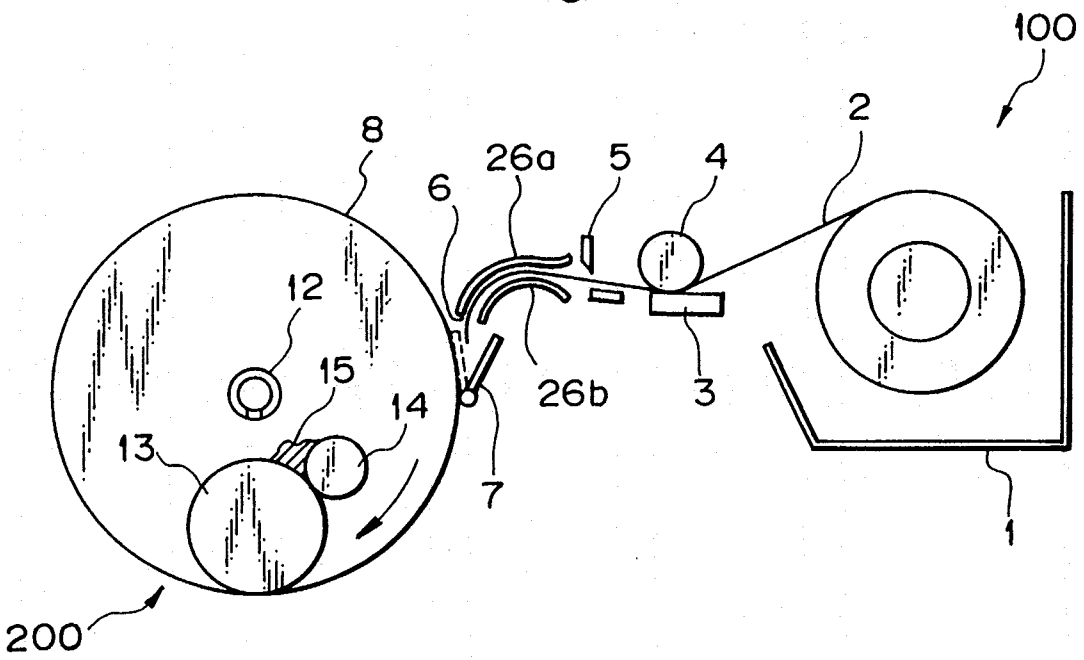
FIG. 2 is a section showing an alternative embodiment of the present invention.

Referring to FIG. 2, an alternative embodiment of the present invention is shown which is capable of transporting the web 2 smoothly along the passageway 6. Briefly, paying attention to the fact that the platen roller 4 not only presses the web 2 against the head 3 but also transports it, this embodiment, like the previous embodiment, causes the roller 4 to feed the leading edge of the web 2 toward the master clamper 7 of the drum 8. Further, considering the fact that the web 2, particularly its leading edge, is apt to curl even after paid out from the roll, i.e., transported by the platen roller 4, the embodiment includes guide plates 26a and 26b which are curved in the same direction as the direction in which the web 2 tends to curl. The passageway 6, therefore, allows the web 2 to advance smoothly therethrough by using the curl of the web 2.

As shown in FIG. 2, as the platen roller 4 is rotated, it transports the web or stencil 2 toward the drum 8 while holding it in cooperation with the head 3. At the same time, the head 3 forms an image in the web 2. At this instant, the master clamper 7 is held in an open position and awaiting the leading edge of the web 2, as in the previous embodiment. As the platen roller 4 is further rotated, the web 2 advances the curved passageway 6 between the guide plates 26a and 26b smoothly due to the curl thereof. Further, the downstream end of the passageway 6 adjoining the master clamper 7 is so curved as to be substantially tangential to the drum 8, so that the leading edge of the web 2 may enter the open end of the master clamper 7 smoothly. As the leading edge of the web 2 abuts against the shaft on which the master clamper 7 is mounted, the clamper 7 is closed to clamp the web 2 on the drum 8. Then, the drum 8 is rotated in the direction indicated by an arrow in the figure so as to wrap the web 2 therearound.

When the web 2 is transported only by the platen roller 4, as in the illustrative embodiment, it is necessary to eliminate the previously discussed problems, e.g., creasing due to the slackening of the web and the degradation and breakage of the web or master 2 ascribable to excessive tensions. For this purpose, the embodiment causes the drum 8 to rotate at a speed slightly higher than the transport speed of the platen roller 4. This successfully eliminates the occurrence that when the web is being wrapped around the drum 8, a tension acts on the web 2 between the drum 8 and the platen roller 4 and causes it to slacken and crease during the wrapping operation.

In the embodiment, the rotation speed of the drum 8 and the transport speed of the web 2 transported in synchronism with the rotation of the platen roller 4 are different, as stated above. Then, it is likely that the tension acting on the web 2 sequentially increases to effect the quality of the resulting master or to break the web. In the light of this, the embodiment includes a torque limiter, not shown, for maintaining the rotating force of the drum 8 smaller than the clamping force with which the platen roller 4 urges the web 2 against the head 3. Then, despite the difference between the rotation speed of the drum 8 and the transport speed of the web 2, the clamping force of the platen roller 4 overcomes the rotating force of the drum 8 to cause the drum 8 to slip. As a result, the tension acting on the web 2 is prevented from sequentially increasing. In addition, since the drum 8 rotates by accurately following the transport speed of the web 2, the position where the head 3 cuts the web 2 is prevented from being deviated to degrade the resulting master, and the web 2 is free from breakage ascribable to an excessive tension otherwise applied thereto.

In the illustrative embodiment, the length of the passageway 6 as measured from the platen roller 4 to the master clamper 7 is selected such that the transporting force of the platen roller 4 acting on the web 2 is not lost. Specifically, the length is such that at the time when the leading edge of the web 2 reaches the clamp position where it abuts against the shaft of the master clamper 7, the portion of the web 2 to be cut off is locate upstream of the cutter 5. Otherwise, the web 2 would be cut off by the cutter 5 before the arrival of the leading edge thereof at the clamp position, cancelling the transporting force of the platen roller 4 acting on the web 2.

As described above, in the first embodiment, a platen roller feeds the leading edge of a web to a master clamper provided on a print drum. The operation for causing the web to form a slack and the operation for applying a tension to the web in the event when the web is to be wrapped around the drum are performed only by a tension member which blocks and unblocks a passageway in association with the opening and closing movements of the master clamper. These operations have heretofore been implemented by two spaced roller pairs. Hence, the embodiment noticeably simplifies the structure of a web transport arrangement and, therefore, realizes an inexpensive and reliable stencil printer.

Also, in the second embodiment, while the master clamper is opened while facing the leading edge of the web, the leading edge of the web can be driven toward the master clamper only by the transporting force of the platen roller. In addition, guide plates defining a passageway for the web are curved in the same direction as the direction in which the web paid out from a roll tends to curl. In this configuration, despite that the position where the transporting force acts on the web is remote from the position where the master clamper clamps the leading edge of the web to the upstream side, the leading edge of the master can advance smoothly along the passageway. This also implements an extremely simple web transport arrangement.

Various modifications will become possible for those skilled in the art after receiving the teachings of the present disclosure without departing from the scope thereof.

What is claimed is:

1. A master making device for a stencil printer which is capable of transporting a web toward a master clamper openably provided on a print drum, said device comprising:

a receptacle for accommodating the web in the form of a roll;

a thermal head for cutting the web paid out from said receptacle to thereby form a document image in said web;

a platen roller rotatable while pressing the web against a surface of said thermal head, and transporting said web toward the print drum while pulling said web out of said receptacle;

a cutter for cutting the web pulled out of said receptacle by said platen roller at a predetermined length;

a guide plate defining a passageway for transporting a leading edge of the web transported by said platen roller toward the master clamper; and a tension member for unblocking said passageway when the master clamper is opened while facing a clamp position for clamping the leading edge of the web, or blocking said passageway in contact with said web when said master clamper is closed to clamp said leading edge of said web and the print drum is rotated for wrapping said web around said print drum, said tension member applying, when blocking said passageway, a tension to said web while causing said web to form a slack at a position downstream of said platen roller;

wherein said tension member is operated by opening and closing movements of the master clamper to block or unblock said passageway.

2. A device as claimed in claim 1, wherein said tension member comprises:

a tension lever movable in a pivotal motion in association with opening and closing movements of the master clamper;

a tension roller movable into and out of contact with a guide surface of said guide plate due to the movement of said tension lever; and a tension spring constantly biasing said tension lever such that said tension roller tends to move toward said guide surface of said guide plate.

3. A master making device for a stencil printer which is capable of transporting a web toward a master clamper openably provided on a print drum, said device comprising:

a receptacle for accommodating the web in the form of a roll;

a thermal head for cutting the web paid out from said receptacle to thereby form a document image in said web;

a platen roller rotatable while pressing the web against a surface of said thermal head, and transporting said web toward the print drum while pulling said web out of said receptacle;

a cutter for cutting the web pulled out of said receptacle by said platen roller at a predetermined length; and a guide plate defining a passageway for transporting a leading edge of the web transported by said platen roller toward the master clamper;

said guide plate being curved in the same direction as a direction in which the web tends to curl.

4. A device as claimed in claim 3, wherein part of said passageway associated with a downstream end portion of said guide plate is curved in such a manner as to be tangential to the print drum at a side adjoining an open portion of the master clamper.

5. A device as claimed in claim 1, wherein a portion of said tension member is located adjacent to said print drum and spaced from said print drum by an amount such that said master clamper contacts said portion when said master clamper is opened, with said master clamper thereby moving said tension member to an unblocking position.

6. A device as claimed in claim 2, wherein a portion of said tension member is located adjacent to said print drum and spaced from said print drum by an amount such that said master clamper contacts said portion when said master clamper is opened, with said master clamper thereby moving said tension member to an unblocking position.

* * * * *